US010801136B2

(12) United States Patent
Loison et al.

(10) Patent No.: US 10,801,136 B2
(45) Date of Patent: Oct. 13, 2020

(54) WOVEN FIBER STRUCTURE PRESENTING A SATIN WEAVE ON AT LEAST ONE OF ITS OUTSIDE FACES

(71) Applicant: ARIANEGROUP SAS, Paris (FR)

(72) Inventors: Sylvie Loison, Saint-Medard en Jalles (FR); Hervé Evrard, Le Haillan (FR); Michel Laxague, Saint-Medard en Jalles (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 16/089,948

(22) PCT Filed: Mar. 29, 2017

(86) PCT No.: PCT/FR2017/050715
§ 371 (c)(1),
(2) Date: Sep. 28, 2018

(87) PCT Pub. No.: WO2017/168091
PCT Pub. Date: Oct. 5, 2017

(65) Prior Publication Data

US 2019/0055681 A1 Feb. 21, 2019

(30) Foreign Application Priority Data

Apr. 1, 2016 (FR) ..... 16 52856

(51) Int. Cl.

| | |
|---|---|
| ***D03D 15/00*** | (2006.01) |
| ***D03D 25/00*** | (2006.01) |
| ***D03D 11/00*** | (2006.01) |
| ***D06C 7/04*** | (2006.01) |

(Continued)

(52) U.S. Cl.
CPC ..... *D03D 15/00* (2013.01); *D03D 1/00* (2013.01); *D03D 11/00* (2013.01); *D03D 13/004* (2013.01); *D03D 25/005* (2013.01); *D06C 7/04* (2013.01); *D10B 2101/12* (2013.01);

(Continued)

(58) Field of Classification Search
None
See application file for complete search history.

(56) References Cited

U.S. PATENT DOCUMENTS 2,400,379 A * 5/1946 Whitman ..... D03D 15/00 139/426 TW
5,980,669 A * 11/1999 Maumus ..... B29B 11/16 156/148

FOREIGN PATENT DOCUMENTS

| | | |
|---|---|---|
| DE | 43 20 521 A1 | 1/1995 |
| EP | 0 399 219 A2 | 11/1990 |
| FR | 2 902 803 A1 | 12/2007 |

(Continued)

OTHER PUBLICATIONS

Machine translation of WO 2006/136755, Coupe et al. (Year: 2006).*

(Continued)

*Primary Examiner* — Shawn Mckinnon
(74) *Attorney, Agent, or Firm* — Pillsbury Winthrop Shaw Pittman LLP

(57) ABSTRACT

A woven fiber structure presenting over at least one of its outside faces a satin weave formed by interlinking a first set of yarns with a second set of yarns; wherein the first set of yarns is in the majority over the outside face, the first set of yarns being formed by a mixture of yarns having an S-twist and of yarns having a Z-twist.

13 Claims, 3 Drawing Sheets

(51) Int. Cl.
*D03D 1/00* (2006.01)
*D03D 13/00* (2006.01)

(52) U.S. Cl.
CPC ..... *D10B 2201/24* (2013.01); *D10B 2321/10* (2013.01); *D10B 2505/02* (2013.01)

(56) References Cited

FOREIGN PATENT DOCUMENTS

| | | | |
|---|---|---|---|
| JP | 2013-022796 | A | 2/2013 |
| WO | WO 2006/136755 | A1 | 12/2006 |

OTHER PUBLICATIONS

A Manual of Weave Construction: A Systematic Arrangement and Explanation of Derivative Weaves for Harness Looms by Ivo Kastenak, 1903 (Year: 1903).*
International Search Report as issued in International Patent Application No. PCT/FR2017/050715, dated Jul. 17, 2017.
Written Opinion of the International Searching Authority as issued in International Patent Application No. PCT/FR2017/050715, dated Jul. 17, 2017.

* cited by examiner

WOVEN FIBER STRUCTURE PRESENTING A SATIN WEAVE ON AT LEAST ONE OF ITS OUTSIDE FACES

CROSS REFERENCE TO RELATED APPLICATIONS

This application is the U.S. National Stage of PCT/FR2017/050715 filed Mar. 29, 2017, which in turn claims priority to French Application No. 1652856, filed Apr. 1, 2016. The contents of both applications are incorporated herein by reference in their entirety.

BACKGROUND OF THE INVENTION

The invention relates in particular to a woven fiber structure comprising yarns made of a carbon precursor or of carbon and presenting, at least at its surface, a mixture yarns having different directions of twist.

It is known to obtain a fiber structure woven with a satin weave and comprising yarns made of carbon by pyrolyzing a fiber structure woven with a satin weave and comprising yarns made of a carbon precursor. To do this, the fiber structure is formed using the carbon precursor, and is then caused to move through an oven by a conveyor system. When moved in this way, at least one of the outside faces of the fiber structure being treated may come into contact with and rub against a wall of the oven. Such rubbing can affect the quality of the method being performed.

Specifically, if the fiber structure is moved in the warp direction and the rubbing outside face is a face in which weft yarns are present in the majority, then the rubbing can give rise to degradation of the fiber structure in that outside face insofar as the direction of movement being imposed extends across the long direction of the majority of the yarns present in the rubbing surface. Adding a lubricant in order to facilitate sliding does not solve this problem in satisfactory manner insofar as the lubricant evaporates at the working temperatures.

The inventors have carried out new tests in which the rubbing surfaces was inverted. In those tests, the fiber structure was moved in the warp direction but the rubbing outside face corresponded to a face in which warp yarns were present in the majority. The problem of damage associated with the rubbing was thereby solved. Nevertheless, in that configuration, the inventors observed the appearance of a new problem associated with the fact that the treated fiber structure tended to shift in a direction extending across the direction of movement. Such deviation required manual interventions for recentering the fabric on the axis of the oven that were too frequent to be envisaged on an industrial scale.

Document FR 2 902 803 is known, which discloses a reinforcing fiber structure for a composite material part and a part comprising such a structure, and Document DE 43 20 521 is known, which discloses a fabric for an inking ribbon.

There therefore exists a need to reduce, or even eliminate, the deviation of the fiber structure woven with a satin weave that is encountered during its travel during heat treatment.

OBJECT AND SUMMARY OF THE INVENTION

To this end, in a first aspect, the invention provides a woven fiber structure comprising yarns made of a carbon precursor and presenting over at least one of its outside faces a satin weave formed by interlinking a first set of yarns with a second set of yarns;

the structure being characterized in that the first set of yarns is in the majority over the outside face, said first set of yarns being formed by a mixture of yarns having an S-twist and of yarns having a Z-twist.

The term "carbon precursor" is used to mean a material that is suitable for being transformed into carbon by pyrolysis heat treatment. By way of example, yarns made of a carbon precursor may be yarns made of polyacrylonitrile (PAN), yarns made of oxidized polyacrylonitrile, yarns made of cellulose, such as rayon yarns, or yarns made of pitch.

The first set of yarns is in the majority over the outside face, i.e. not less than 50% of the yarns present over the outside face are yarns of the first set of yarns.

The yarns of the first set of yarns may be warp yarns and the yarns of the second set of yarns may be weft yarns, or conversely, the yarns of the first set of yarns may be weft yarns and the yarns of the second set of yarns may be warp yarns. For all purposes, it is specified that, unless mentioned to the contrary in the text below, interchanging roles between warp and weft is possible, and should be considered as also being covered by the claims.

In the event of the outside face rubbing during heat treatment of the fiber structure, the inventors have observed that having a mixture of yarns with different twist directions (S or Z twist directions) present over the outside face of the fiber structure serves to reduce the deviation of the structure. Specifically, the inventors have observed that the observed deviation phenomenon is associated with the twist direction of the yarns present over the outside face of the fiber structure. Thus, if the outside face presents only yarns having an S-twist, then the fiber structure is shifted significantly in a given direction. On the contrary, if the outside face presents only yarns having a Z-twist, then the fiber structure is shifted significantly in the opposite direction. Thus, the invention proposes "averaging out" those deviations in opposite directions by using a mixture of yarns having different twist directions in the outside face of the fiber structure so as to reduce the observed phenomenon of deviation.

In a second aspect, the invention provides a woven fiber structure comprising yarns made of carbon and presenting over at least one of its outside faces a satin weave formed by interlinking a first set of yarns with a second set of yarns;

the structure being characterized in that the first set of yarns is in the majority over the outside face, said first set of yarns being formed by a mixture of yarns having an S-twist and of yarns having a Z-twist.

Such a fiber structure with carbon fibers corresponds to the product that is obtained after subjecting the above-described fiber structure with carbon precursor fibers to pyrolysis treatment.

Preferably, the ratio of [the number of S-twist yarns in the first set of yarns] divided by [the number of Z-twist yarns in the first set of yarns] may lie in the range 0.75 to 1.25.

Such a characteristic serves advantageously to reduce very significantly, or even to eliminate completely, the phenomenon of deviation of the fiber structure, insofar as the S-twist yarns and the Z-twist yarns are present in substantially the same proportions. More preferably, this ratio may lie in the range 0.9 to 1.1, or may even be substantially equal to 1.

In an embodiment, the fiber structure may be a structure woven two-dimensionally with a satin weave.

In a variant, the fiber structure may be formed by three-dimensional weaving.

The term "three-dimensional weaving" or "3D weaving" should be understood as weaving in such a manner that at least some of the warp yarns interlink weft yarns over a plurality of weft layers.

Under such circumstances, the fiber structure may be a multi-satin woven fabric, i.e. a fabric obtained by three-dimensional weaving with a plurality of weft yarns in which the base weave in each layer is equivalent to a conventional satin type weave, but with certain weave points that interlink the weft yarn layers with one another. In a variant, the structure may have an outer portion, or "skin", adjacent to the outside face formed by the satin weave with the mixture of yarns having different twist directions and an inner portion, or core, formed by weaving using a weave other than satin weave, for example an interlock weave. The term "interlock weave or fabric" should be understood as a 3D weave in which each layer of warp yarns interlinks a plurality of layers of weft yarns, with all of the yarns in the same warp column having the same movement in the weave plane. Various multilayer weaving techniques suitable for forming the core are described in particular in Document WO 2006/136755. One such embodiment corresponds to a woven structure presenting a varying weave. The core of the woven structure may for example be formed by weaving yarns or braids.

Preferably, the structure may comprise over its outside face:

- a first yarn of the second set of yarns forming a first set of satin points;
- a second yarn of the second set of yarns, adjacent to the first yarn of the second set of yarns, and forming a second set of satin points, the satin points of the second set being offset from the satin points of the first set by a first spacing; and
- a third yarn of the second set of yarns, adjacent to the second yarn of the second set of yarns, and forming a third set of satin points, the satin points of the third set being offset from the satin points of the second set by a second spacing different from the first spacing.

The inventors have observed that such a relative distribution of sets of satin points contributes advantageously to further reducing the deviation of the fiber structure that is observed during its heat treatment.

The present invention also provides a method of treating a fiber structure as described above, including at least one step of subjecting the fiber structure to heat treatment, in which the fiber structure is caused to move through a heating enclosure in the long direction of the yarns of the first set.

During the heat treatment, the fiber structure is arranged so that the outside face is its face rubbing against the heating enclosure, and movement takes place in the long direction of the yarns of the first set, which are in the majority over the outside face, so as to avoid damaging the fiber structure while it rubs against the heating enclosure. Thus, as a result of the presence, over the outside face, of a mixture of fibers having different twist directions, the above-described heat treatment of the fiber structure does not lead to damage of the structure, while also limiting, or even eliminating, the phenomenon of deviation.

This method may be used for fabricating the above-described woven fiber structure incorporating carbon fibers by pyrolyzing yarns made of carbon precursor. Thus, the present invention also provides a heat treatment method in which a structure as described above comprising yarns made of a carbon precursor is subjected to pyrolysis in a heating enclosure in order to obtain the above-described structure comprising yarns made of carbon.

In a variant, the method may constitute a method of thermal de-sizing in which a sized fiber structure as described above (with yarns made of carbon or of carbon precursor) is treated.

The present invention also provides a method of fabricating a composite material part, the method comprising at least the following steps:

- forming a fiber preform of the part that is to be obtained from one or more fiber structures comprising yarns made of carbon as described above; and
- forming a matrix within the pores of the preform in order to obtain the composite material part.

In an implementation, the matrix that is formed may be an organic matrix, a ceramic matrix, or a carbon matrix. When the matrix is an organic matrix, the method may include impregnating the fiber preform with a resin in the fluid state, such as a phenolic resin. The resin used may be a thermoplastic resin or a thermosetting resin, and when a thermosetting resin is used, it is polymerized after impregnation in order to obtain the organic matrix.

Nevertheless, it would not go beyond the ambit of the present invention if a different matrix were to be formed. By way of example, the matrix may thus be made at least in part out of carbon or out of a ceramic material, such as silicon carbide (SiC). With silicon carbide, the matrix may be formed by a liquid densification technique comprising impregnating with a precursor for the material of the matrix that is to be formed followed by pyrolyzing the precursor. In a variant, or in combination, it is possible to use densification by a gas technique (chemical vapor infiltration) or a melt-infiltration technique in order to form all or part of the matrix.

BRIEF DESCRIPTION OF THE DRAWINGS

Other characteristics and advantages of the invention appear from the following description of particular embodiments of the invention given as non-limiting examples with reference to the accompanying drawings, in which.

DETAILED DESCRIPTION OF EMBODIMENTS

Figure 1:
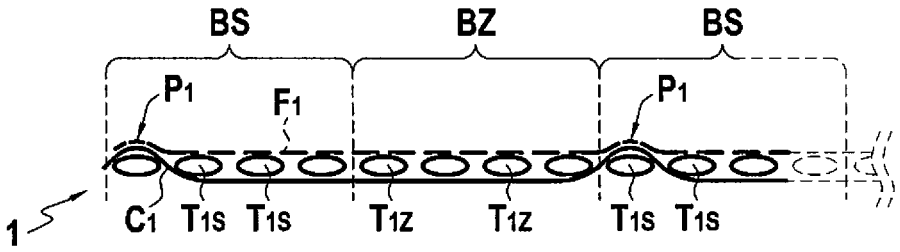
FIG. 1 shows a weave plane relating to an embodiment of a woven structure of the invention.

FIG. 1 shows a weave plane relating to a first embodiment of a woven structure 1 of the invention. The woven structure 1 shown is a two-dimensional structure woven with a satin weave. Over its outside face F1, the woven structure 1 presents a satin weave formed by interlinking weft yarns T1S and T1Z with warp yarns C1. The yarns present over the outside face F1 are carbon yarns or yarns made of a carbon precursor. The woven structure 1 is constituted by carbon yarns or yarns made of a carbon precursor. The description below applies in equivalent manner to both of these alternatives.

The weave plane of the woven structure 1 has a single layer of weft yarns T1S and T1Z and a single layer of warp yarns C1. Each warp yarn C1 is periodically deflected so as to catch one weft yarn in every n, where n is an integer greater than or equal to 3, so as to provide interlinking between the weft yarns T1S, T1Z, and the warp yarns C1. In the example shown, n is equal to 8, however it would not go beyond the ambit of the present invention for n to take some other value, providing it remains not less than 3. The warp yarns C1 define satin points P1 at the weft yarns they catch.

In the example shown, there are more weft yarns T1S and T1Z over the outside face F1 than there are warp yarns C1. Thus, in this example, the first set of yarns corresponds to the weft yarns T1S, T1Z, and the second set of yarns corresponds to the warp yarns C1. The yarns C1 of the second set are situated in the outside face F1 only at the satin points P1. Nevertheless, it would not go outside the ambit of the invention to use the inverse configuration (first set corresponding to the warp yarns and second set corresponding to the weft yarns). As shown, the yarns present over the outside face F1 comprise more than 50%, possibly not less than 75% yarns of the first set of yarns T1S and T1Z.

The first set of yarns (in this example the weft yarns T1S and T1Z) is formed by carbon yarns or by yarns made of a carbon precursor. The first set of yarns comprises both yarns having an S-twist and yarns having a Z-twist. The second set of yarns C1 may be formed by yarns all having the same twist direction or, in a variant, by a mixture of yarns having the S-twist direction and of yarns having the Z-twist direction. The second set of yarns is also formed of carbon yarns or of yarns made of a carbon precursor. In the example shown, and as described in greater detail below, the outside face F1 is to constitute the face that rubs against the heating enclosure while the fiber structure 1 is being subjected to heat treatment, and said structure 1 is to be set into movement in the long direction of the yarns T1S and T1Z of the first set during this heat treatment. The first set of yarns T1S and T1Z in the example shown comprises alternating blocks BS of yarns T1S having an S-twist direction and blocks BZ of yarns T1Z having a Z-twist direction. In other words, on going along the long direction of the yarns of the second set, the fiber structure 1 presents, in succession, at least a first block BS of yarns T1S of the first set having an S-twist direction, a first block BZ of yarns T1Z of the first set having a Z-twist direction, a second block BS of yarns T1S of the first set having an S-twist direction, and a second block BZ of yarns T1Z of the first set having a Z-twist direction. In the example shown, each of the blocks BS and BZ of yarns of the first set presents the same number of yarns, however it would not go beyond the ambit of the invention for each of these blocks to present a different number of yarns. Thus, in the example shown, the ratio of [the number of S-twist yarns T1S in the first set of yarns] divided by [the number of Z-twist yarns T1Z in the first set of yarns] is equal to 1, however within the context of the invention this ratio may take on other values depending on the relative proportions of S-twist yarns and of Z-twist yarns. In the example shown, each of the blocks BS and BZ has four yarns of the first set, however, more generally, and by way of example, each of these blocks BS and BZ may comprise at least two yarns of the first set of yarns. The warp yarns C1 present similar movement in all of the weave planes of the woven structure 1.

Figure 2:
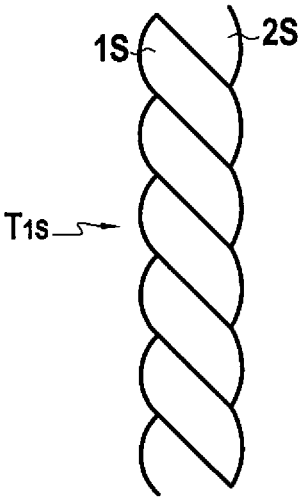
FIG. 2 shows a yarn having an S-twist direction.
Figure 3:
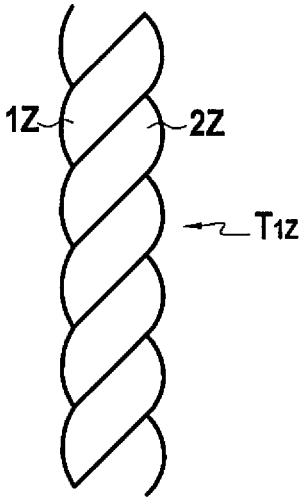
FIG. 3 shows a yarn having a Z-twist direction.

FIG. 2 shows an example of an S-twist yarn T1S and FIG. 3 shows an example of a Z-twist yarn T1Z. Each of the yarns T1S and T1Z is constituted by twisting a plurality of fibers 1S and 2S or else 1Z and 2Z. Depending on the direction in which these fibers are twisted together, the yarn is referred to in conventional manner as presenting an S-twist or a Z-twist.

As mentioned above, because of the presence of the first set of yarns having yarns with different twist directions, such a fiber structure 1 makes it possible to limit the deviation of the fiber structure while it is traveling through a heating enclosure.

Figure 4:
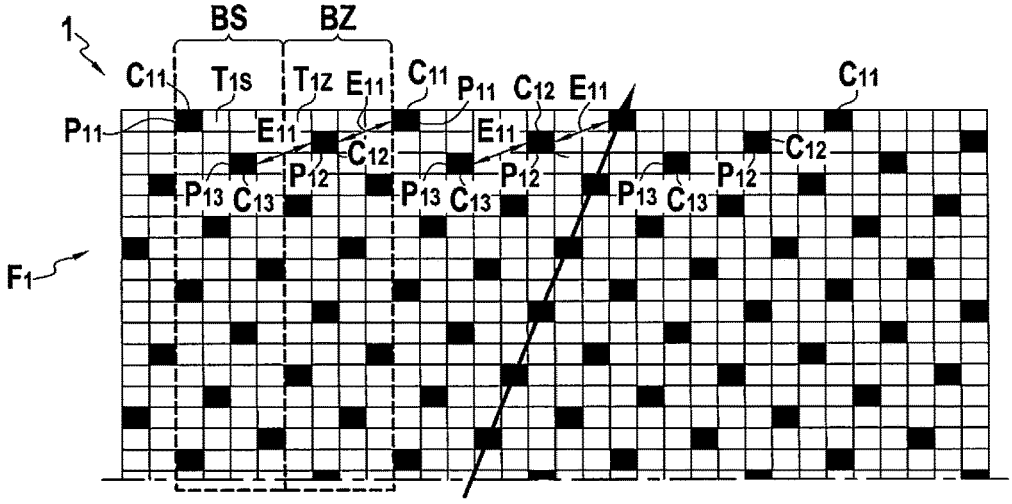
FIG. 4 shows the distribution of satin points over the outside face of the woven structure shown in FIG. 1.

FIG. 4 shows the distribution of satin points over the outside face F1 of the woven structure 1 shown in FIG. 1. In this figure, the satin points are represented by black rectangles. In the example shown, and as shown in FIG. 1, the yarns C11, C12, . . . , C1*n* of the second set C1 are adjacent to the outside face F1 only at the satin points P11, . . . , P1*n*. The yarns T1S and T1Z of the first set situated in the outside face F1 are represented by white rectangles in FIG. 4. FIG. 4 also shows the positions of the blocks BS (yarns of the first set having an S-twist direction) and BZ (yarns of the first set having a Z-twist direction).

The woven structure 1 shown in FIG. 4 includes over its outside face F1 a first yarn C11 of the first set forming a first set of satin points P11. The structure 1 also includes over its outside face F1 a second yarn C12 of the second set, the second yarn C12 being adjacent to the first yarn C11 and forming a second set of satin points P12. The structure 1 also includes over its outside face F1 a third yarn C13 of the second set adjacent to the second yarn C12 and forming a third set of satin points P13.

In the example structure 1 shown in FIG. 4, the satin points P12 of the second set are offset from the satin points P11 of the first set by a first spacing written "E11". In the same manner, the satin points P13 of the third set are offset from the satin points P12 of the second set by the same spacing E11. More generally, in the example shown, it can be seen that the satin points of two adjacent sets of satin points correspond to moving one rectangle downwards and three rectangles to the left. This correspondence is unchanging over the entire outside face leading to a mutually "aligned" distribution of satin points as represented by the arrow that appears in FIG. 4. Nevertheless, it would not go beyond the ambit of the invention for the spacing between adjacent sets of satin points to vary, as described below.

Figure 5:
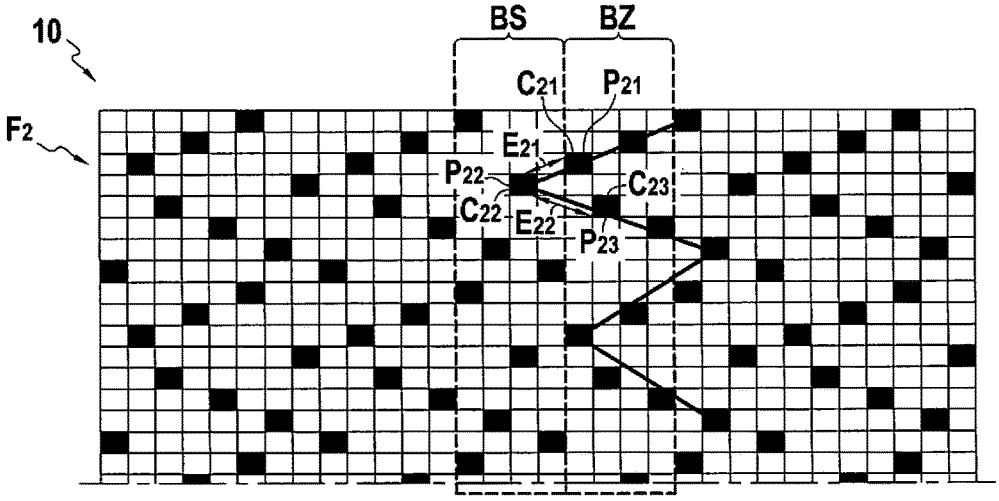
FIG. 5 shows the distribution of satin points over an outside face of another embodiment of the woven structure of the invention.

FIG. 5 shows the distribution of satin points over the outside face F2 in a variant woven structure 10 of the invention. The satin points are represented by black rectangles. In the example shown, the yarns C21, C22, . . . , C2*n* of the second set are adjacent to the outside face F2 only at the satin points P21, . . . , P2*n*. The yarns T2S and T2Z of the first set situated in the outside face F2 are represented by white rectangles. FIG. 5 also shows the positions of the blocks BS (yarns of the first set having an S-twist direction) and BZ (yarns of the first set having a Z-twist direction).

The woven structure 10 shown in FIG. 5 includes over its outside face F2 a first yarn C21 of the second set forming a first set of satin points P21. The structure 10 also includes over its outside face F2 a second yarn C22 of the second set, the second yarn C22 is adjacent to the first yarn C21 and forms a second set of satin points P22. The structure 10 also has over its outside face F2 a third yarn C23 of the second set adjacent to the second yarn C22 and forming a third set of satin points P23.

In the example structure 10 shown in FIG. 5, the satin points P22 of the second set are offset from the satin points P21 of the first set by a first spacing written "E21". The satin points P23 of the third set are offset from the satin points P22 of the second set by a different spacing E22. Specifically, in the example shown, it can be seen that to go from a satin point of the first set to a satin point of the second set it is necessary to move one rectangle downwards and two rectangles to the left. However to go from a satin point of the second set to a satin point of the third set it is necessary to move one rectangle downwards and three rectangles to the right. In the example of FIG. 5, the satin points are distributed in a chevron configuration, as shown.

Figure 6:
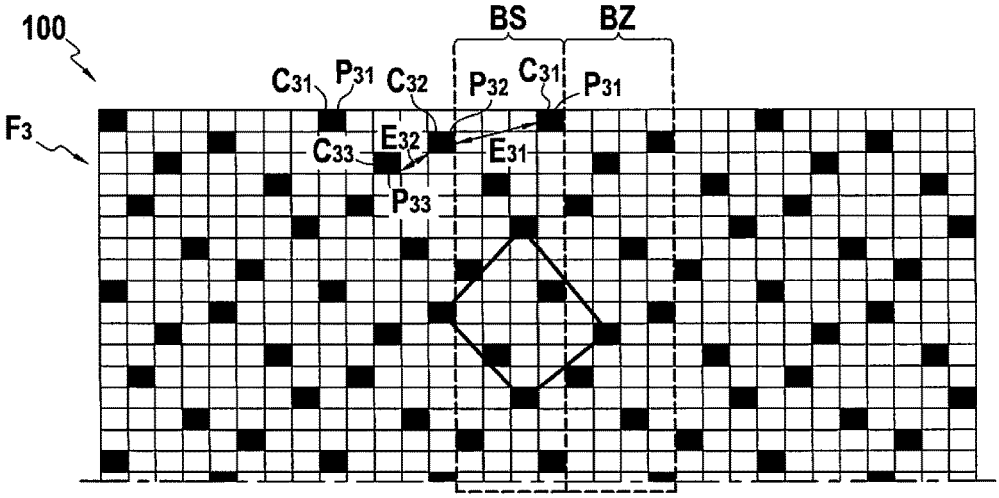
FIG. 6 shows the distribution of satin points over an outside face of another embodiment of a woven structure of the invention.

FIG. 6 shows the distribution of satin points over the outside face F3 in another variant woven structure 100 of the invention. The satin points are represented by black rectangles. In the example shown, the yarns C31, C32, . . . , C3*n* of the second set are adjacent to the outside face F3 only at the satin points P31, . . . , P3*n*. The yarns T3S and T3Z of the first set situated in the outside face F3 are represented by white rectangles. FIG. 6 also shows the positions of the blocks BS (yarns of the first set having an S-twist direction) and BZ (yarns of the first set having a Z-twist direction).

The woven structure 100 shown in FIG. 6 includes over its outside face F3 a first yarn C31 of the second set forming a first set of satin points P31. The structure 100 also includes over its outside face F3 a second yarn C32 of the second set, the second yarn C32 is adjacent to the first yarn C31 and forms a second set of satin points P32. The structure 10 also includes over its outside face F3 a third yarn C33 of the second set adjacent to the second yarn C32 and forming a third set of satin points P33.

In the example structure 100 shown in FIG. 6, the satin points P32 of the second set are offset from the satin points P31 of the first set by a first spacing written "E31". The satin points P33 of the third set are offset from the satin points P32 of the second set by a different spacing E32. Specifically, it can be seen in the example shown, that to go from a satin point of the first set to a satin point of the second set it is necessary to move one rectangle downwards and four rectangles to the left. To go from a satin point of the second set to a satin point of the third set, it is necessary to move one rectangle downwards and two rectangles to the left. In the example of FIG. 6, the satin points are distributed in a lozenge configuration, as shown.

The inventors have observed that the embodiments shown in FIGS. 5 and 6 that make use of varying spacing between the adjacent sets of satin points serve advantageously to further reduce the deviation of the fiber structure during its heat treatment.

Figure 7:
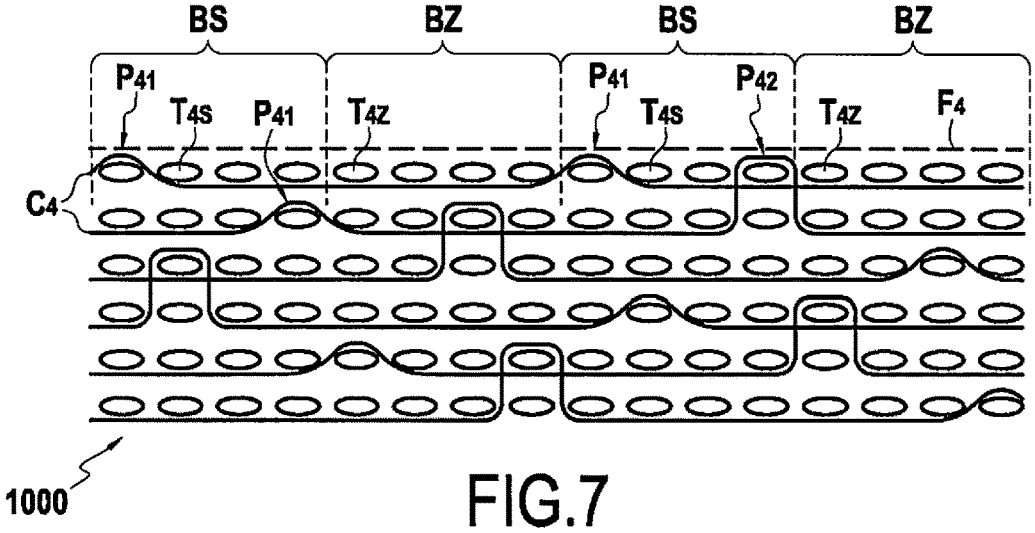
FIG. 7 shows a weave plane relating to a variant woven structure of the invention.

FIG. 7 shows a multilayer 3D weave plane of satin type (a multi-satin weave) interlinking a plurality of layers of weft yarns T4S and T4Z. The woven structure 1000 shown presents a satin weave over its outside face F4 that is formed by interlinking weft yarns T4S and T4Z with warp yarns C4. In the same manner as described above, the yarns present over the outside face F4 are carbon yarns or yarns made of a carbon precursor. In the example shown, there are more weft yarns T4S and T4Z over the outside face F4 than are warp yarns C4. Thus, in this example, the first set of yarns corresponds to the weft yarns T4S and T4Z, and the second set of yarns corresponds to the warp yarns C4. The yarns C4 of the second set are situated in the outside face F4 only at the satin points P4. Nevertheless, it would not go beyond the ambit of the invention if the inverse configuration were to be considered (first set corresponding to warp yarns and second set corresponding to weft yarns). In the same manner as for the embodiment shown in FIG. 1, the first set of yarns T4S, T4Z in the example shown comprises alternating blocks BS of T4S yarns having an S-twist direction and blocks BZ of T4Z having a Z-twist direction.

The warp yarns C4 are periodically deflected from their path over a weft layer so as to alternate between catching a weft yarn of that weft layer, and catching together a weft yarn of that weft layer together with a weft yarn situated in the same column of the adjacent higher weft layer. Conventional single satin points P41 are thus formed in alternation with double satin points P42 interlinking the yarns of two adjacent weft layers, thereby providing interlinking between weft layers.

Figure 8:
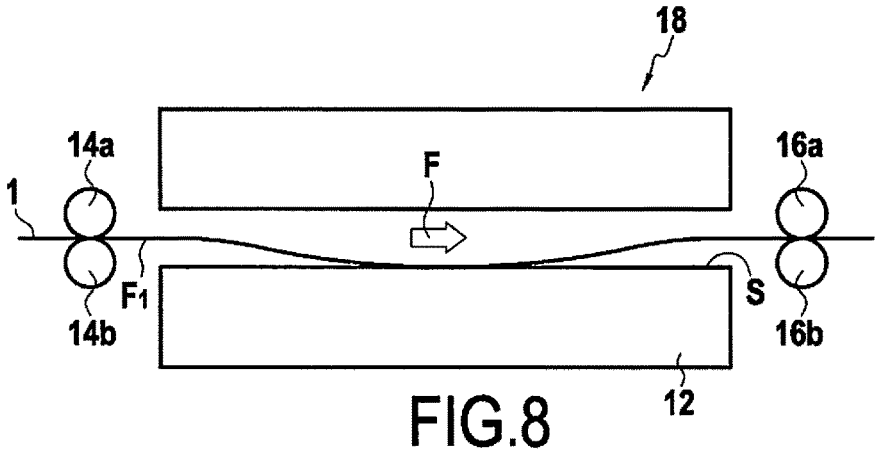
FIG. 8 is a diagram showing the heat treatment applied to a woven structure of the invention passing through a heating enclosure.

FIG. 8 is a diagram showing how a heat treatment method is implemented on the fiber structure 1 described in FIG. 1. During the method, the fiber structure 1 is caused to move by means of a conveyor system through a heating enclosure 18. The conveyor system has a first set of rollers 14*a* and 14*b* and a second set of rollers 16*a* and 16*b* arranged at opposite ends of the heating enclosure 18, thereby enabling the structure 1 to travel through the heating enclosure 18. The structure 1 is caused to move in the long direction of the yarns of the first set (arrow F). The structure 1 can move through the heating enclosure 18 in continuous manner (i.e. without stopping) or in discontinuous manner (i.e. in increments, alternating between at least one stage of moving and at least one stage of stopping). In the example shown, the yarns of the first set are the weft yarns T1S and T1Z, however it would not go beyond the ambit of the invention for them to be the warp yarns. Because of its weight, the fiber structure 1 cannot present an accurately rectilinear shape while it is moving through the heating enclosure 18, which can lead to the structure 1 rubbing against the inside of said enclosure 18 against a surface S of a wall 12 of the enclosure 18. The fiber structure 1 is also arranged in such a manner that it is the outside face F1 which is the face that rubs against the heating enclosure 18. As mentioned above, such a configuration makes it possible during heat treatment to avoid deviation of the fiber structure 1 and to avoid it being damaged as it passes through the enclosure 18. In the heat treatment method of the invention, when the fiber structure 1 is moved in the warp direction (i.e. in the long direction of the warp yarns of the fiber structure), the outside face that is to rub against the inside of the heating enclosure is a warp face (i.e. a face in which warp yarns are present in the majority). In analogous manner, when the movement is performed in the weft direction (i.e. along the long direction of the weft yarns in the fiber structure), the outside face that is to rub against the inside of the heating enclosure is a weft face (i.e. a face in which weft yarns are present in the majority).

The heating enclosure 18 may be provided with one or more heater members for imposing the desired temperature inside the enclosure. In a variant, the heating enclosure 18 is placed in an oven configured to impose the desired working temperature. By way of example, the fiber structure 1 may be constituted by yarns made of a carbon precursor and, while it is passing through the enclosure 18, it may be subjected to pyrolysis heat treatment in order to transform the carbon precursor into carbon. In a variant, the heat treatment performed in the enclosure 18 may be thermal de-sizing treatment or thermochemical type treatment. In general manner, the temperature imposed inside the heating enclosure 18 may be greater than or equal to 200° C. In addition, the heated fiber structure 1 may be dry, in particular it need not be coated with a lubricant.

Figure 9:
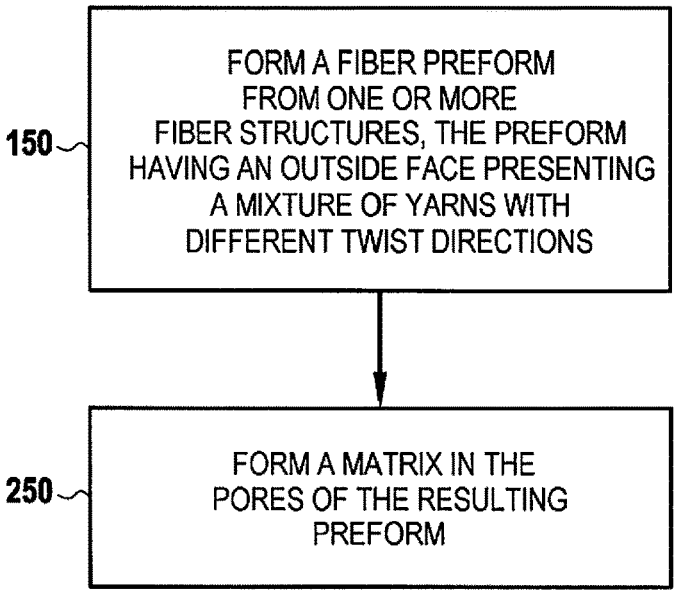
FIG. 9 is a flow chart showing steps of a method of the invention for fabricating a composite material part.

FIG. 9 is a flow chart of a method of fabricating a composite material part. In this method, a first step 150 is performed in order to form a fiber preform from one or more fiber structures as described above. By way of example, a preform may be obtained by draping a plurality of fiber structures on a mandrel in conventional manner. A matrix is then formed in the pores of the fiber preform as obtained in this way (step 250). The matrix serves to fill in the pores of the preform throughout all or part of its volume. The matrix may be an organic matrix and it may be formed by impregnating the fiber preform with a resin and then polymerizing the resin. Under such circumstances, the preform is placed in a mold having a cavity that presents the shape for the molded final part. Resin is injected into the cavity of the mold in order to impregnate the fiber preform, and heat treatment is then performed in order to polymerize the resin.

In a variant, the matrix may be formed in conventional manner using a liquid densification technique (liquid consolidation (LC)) or a gas densification technique (chemical vapor infiltration (CVI)), or indeed by both of these two methods one after the other.

Liquid consolidation consists in impregnating the preform with a liquid composition containing a precursor for the matrix material. The precursor is usually in the form of a polymer, such as a resin, possibly diluted in a solvent. The precursor is transformed into a matrix by heat treatment, generally by heating the mold, after eliminating the solvent, if any, and curing the polymer, the preform being maintained throughout inside the mold that has a shape corresponding to the shape of the part that is to be made. When forming a ceramic matrix, the heat treatment includes a step of pyrolyzing the precursor in order to form the ceramic matrix. By way of example, liquid precursors for ceramics, in particular for SiC, may be resins of polycarbosilane (PCS), or polytitanocarbosilane (PTCS), or polysilazane (PSZ) type. Several consecutive cycles from impregnation to heat treatment may be performed in order to achieve the desired degree of densification.

In known manner, the fiber preform may also be densified by chemical vapor infiltration (CVI) of the matrix. The fiber preform corresponding to the structure that is to be made is placed in an oven into which a reaction gas phase is admitted. The pressure and the temperature that exist inside the oven, and the composition of the gas phase, are all selected so as to enable the gas phase to diffuse within the pores of the preform so as to form the matrix therein by depositing a solid material within the material in contact with the fibers, the solid material resulting from one of the components of the gas phase decomposing, or from a reaction between a plurality of its components. An SiC matrix may be formed using methyltrichlorosilane (MTS) that produces SiC by decomposition of the MTS.

It is also possible to perform densification by combining the liquid technique and the gas technique in order to facilitate implementation, limit costs, and reduce fabrication cycles, while still obtaining characteristics that are satisfactory for the intended use.

The term "lying in the range . . . to . . . " should be understood as including the bounds.

The invention claimed is:

1. A method of treating a woven fiber structure that includes yarns made of a carbon precursor and presenting over at least one of its outside faces a satin weave formed by interlinking a first set of yarns with a second set of yarns;

wherein the first set of yarns is in the majority over the outside face, said first set of yarns being formed by a mixture of yarns having an S-twist and of yarns having a Z-twist; and wherein the structure includes over its outside face:

a first yarn of the second set of yarns forming a first set of satin points;

a second yarn of the second set of yarns, adjacent to the first yarn of the second set of yarns, and forming a second set of satin points, the satin points of the second set being offset from the satin points of the first set by a first spacing, wherein the first spacing is the minimal distance between all the satin points of the second set and all the satin points of the first set; and a third yarn of the second set of yarns, adjacent to the second yarn of the second set of yarns, and forming a third set of satin points, the satin points of the third set being offset from the satin points of the second set by a second spacing different from the first spacing, wherein the second spacing is the minimal distance between all the satin points of the third set and all the satin points of the second set, and wherein the first, second and third yarns are consecutive yarns in this order along a direction that is transverse to a longitudinal direction of said first, second and third yarns, the method comprising:

moving said woven fiber structure in an enclosure, wherein said fiber structure is moved along a direction of the yarns of the first set of yarns and wherein, during said moving, at least a portion of the outside face rubs against a wall of the enclosure.

2. A method according to claim 1, wherein the enclosure is a heating enclosure.

3. A method of treating a woven fiber structure that includes yarns made of carbon and presenting over at least one of its outside faces a satin weave formed by interlinking a first set of yarns with a second set of yarns;

wherein the first set of yarns is in the majority over the outside face, said first set of yarns being formed by a mixture of yarns having an S-twist and of yarns having a Z-twist; and wherein the structure includes over its outside face:

a first yarn of the second set of yarns forming a first set of satin points;

a second yarn of the second set of yarns, adjacent to the first yarn of the second set of yarns, and forming a second set of satin points, the satin points of the second set being offset from the satin points of the first set by a first spacing; wherein the first spacing is the minimal distance between all the satin points of the second set and all the satin points of the first set; and a third yarn of the second set of yarns, adjacent to the second yarn of the second set of yarns, and forming a third set of satin points, the satin points of the third set being offset from the satin points of the second set by a second spacing different from the first spacing, wherein the second spacing is the minimal distance between all the satin points of the third set and all the satin points of the second set, and wherein the first, second and third yarns are consecutive yarns in this order along a direction that is transverse to a longitudinal direction of said first, second and third yarns, the method comprising:

moving said woven fiber structure in an enclosure, wherein said fiber structure is moved along a direction of the yarns of the first set of yarns and wherein, during said moving, at least a portion of the outside face rubs against a wall of the enclosure.

4. A method according to claim 3, wherein the enclosure is a heating enclosure.

5. A method according to claim 1, wherein the ratio of [the number of S-twist yarns in the first set of yarns] divided by [the number of Z-twist yarns in the first set of yarns] lies in the range 0.75 to 1.25.

6. A method according to claim 1, wherein the fiber structure is a satin weave two-dimensionally woven structure.

7. A method according to claim 1, wherein the fiber structure is formed by three-dimensional weaving.

8. A method according to claim 1, wherein the fiber structure is a multi-satin woven fabric.

9. A method according to claim 3, wherein the enclosure is a heating enclosure and wherein the fiber structure is subjected to pyrolysis in the heating enclosure.

10. A method of fabricating a composite material part comprising at least the following steps:

forming a fiber preform from one or more woven fiber structures treated according to the method of claim 1, and forming a matrix within the pores of the fiber preform in order to obtain the composite material part.

11. A method according to claim 10, wherein the matrix that is formed is an organic matrix, a ceramic matrix, or a carbon matrix.

12. A method of fabricating a composite material part comprising at least the following steps:

forming a fiber preform from one or more woven fiber structures treated according to the method of claim 3, and forming a matrix within the pores of the fiber preform in order to obtain the composite material part.

13. A method according to claim 12, wherein the matrix that is formed is an organic matrix, a ceramic matrix, or a carbon matrix.

* * * * *